US007040927B1

(12) United States Patent
Liu

(10) Patent No.: US 7,040,927 B1
(45) Date of Patent: May 9, 2006

(54) MODULAR COMMUNICATIONS SOCKET

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 11/168,502

(22) Filed: Jun. 28, 2005

(51) Int. Cl.
*H01R 13/66* (2006.01)

(52) U.S. Cl. ..... 439/620; 439/490

(58) Field of Classification Search ..... 439/620, 439/676, 490
See application file for complete search history.

(56) References Cited

U.S. PATENT DOCUMENTS 6,102,741 A * 8/2000 Boutros et al. ..... 439/620
6,428,361 B1 * 8/2002 Imschweiler et al. ..... 439/676
6,719,588 B1 * 4/2004 Zheng et al. ..... 439/620
6,776,651 B1 * 8/2004 Liu ..... 439/490
6,984,155 B1 * 1/2006 Liu ..... 439/676

* cited by examiner

*Primary Examiner*—Briggitte R. Hammond
*Assistant Examiner*—X. Chung-Trans
(74) *Attorney, Agent, or Firm*—William E. Pelton, Esq.

(57) ABSTRACT

A modular communications socket has a chassis, a main circuit board and a socket block. The chassis has a front and a rear. The main circuit board is mounted on the chassis near the rear of the chassis and electrically connects to the other circuit board. The socket block is mounted on the chassis near the front and has a contact assembly and a secondary circuit board. The secondary circuit board is mounted on the socket block and electrically connects to the main circuit board. The contact assembly is mounted in the socket block and electrically connects to the secondary circuit board. The circuits on the circuit boards connect the contact assembly simply to circuit board in the parent equipment through the main and secondary circuit boards.

4 Claims, 5 Drawing Sheets

MODULAR COMMUNICATIONS SOCKET

BACKGROUND OF THE INVENTION

1. Field of the Invention

The present invention relates to a socket, especially to a modular communications socket.

2. Description of the Prior Arts

Modular communications sockets are mounted in ports or interfaces in electronic equipment such as computers, facsimile machines, telephones and the like to connect signals transported over wires to the equipment. A conventional modular communications socket comprises a chassis, a circuit board, a socket block, a contact assembly and a chassis cover. The circuit board is mounted on the chassis and has multiple electrical prongs and multiple internal leads extending through the chassis to connect to another circuit board in the electronic equipment. The socket block is mounted on the chassis and has a cavity. The cavity has a top and a bottom. The contact assembly is mounted in the bottom of the cavity and has multiple resilient contacts. The resilient contacts correspond respectively to the electrical prongs on the circuit board, and each resilient contact has a lead to connect to the corresponding electrical prong. The chassis cover is mounted on and covers the socket block, the circuit board and the chassis.

Because the distance between adjacent resilient contacts of the contact assembly is very short, the connection has to be very precise when the leads of the resilient contacts of the contact assembly are connected to the corresponding electrical prongs. Therefore, the connection is complicated and time-consuming. When the modular communications socket needs to have the contact assembly mounted in the top of the cavity, the connection process between the leads of the resilient contacts of the contact assembly and the corresponding electrical prongs needs to be changed. Since the connection is complicated and time-consuming, changing the connection process is also complicated and time-consuming.

To overcome the shortcomings, the present invention provides an improved modular communications socket to mitigate or obviate the aforementioned problems.

SUMMARY OF THE INVENTION

The main objective of the present invention is to provide a modular communications socket that simplifies the lead connection. The modular communications socket has a chassis, a main circuit board and a socket block. The chassis has a front and a rear. The main circuit board is mounted on the chassis near the rear of the chassis and electrically connects to the other circuit board. The socket block is mounted on the chassis near the front and has a contact assembly and a secondary circuit board. The secondary circuit board is mounted on the socket block and electrically connects to the main circuit board. The contact assembly is mounted in the socket block and electrically connects to the secondary circuit board. The circuits on the circuit boards connect the contact assembly simply to the circuit board in the parent equipment.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
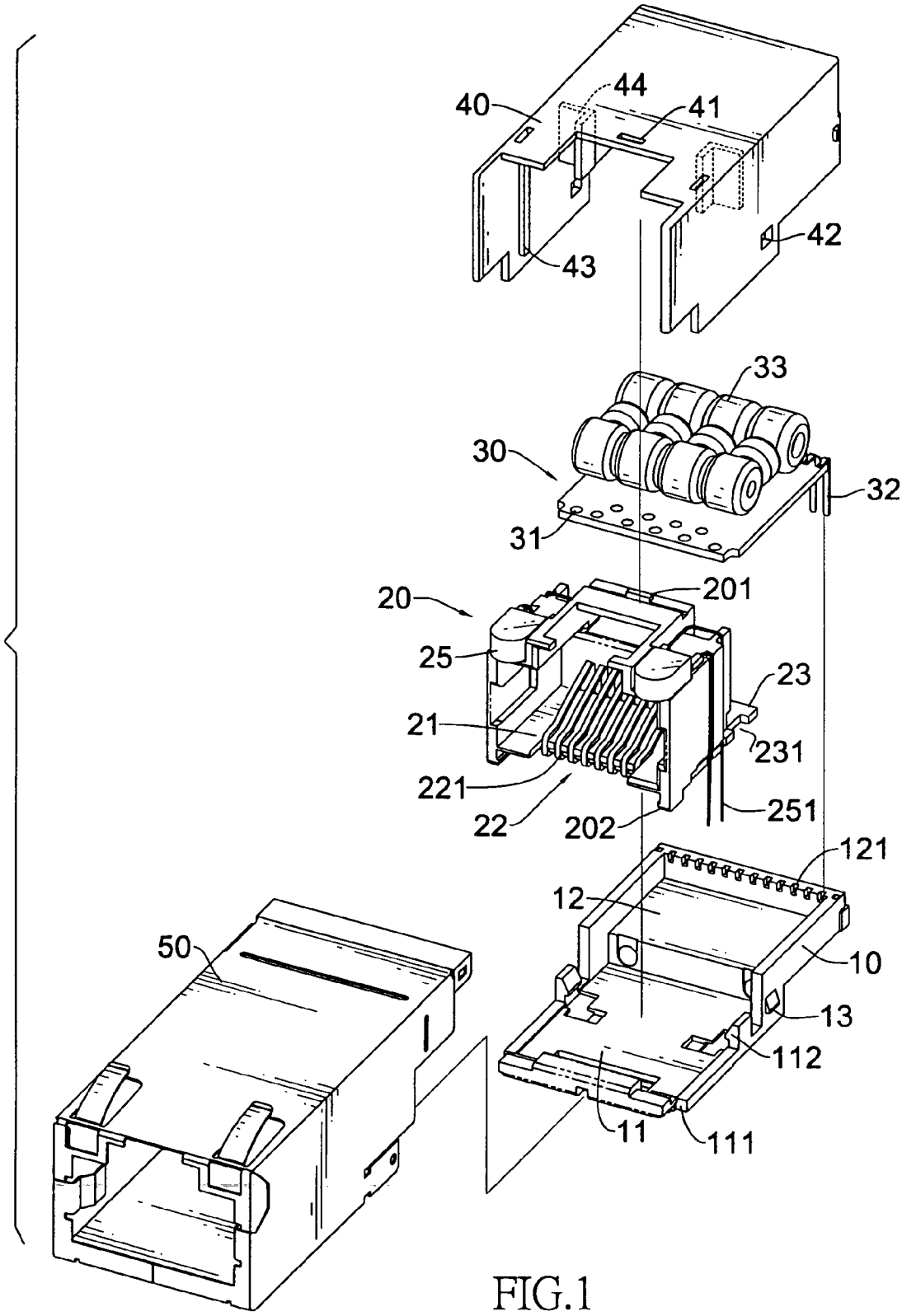
FIG. 1 is an exploded perspective view of an RJ-45 socket in accordance with the present invention.

With reference to FIG. 1, a modular communications socket in accordance with the present invention comprises a chassis (10), a main circuit board (30), a socket block (20), a chassis cover (40), multiple filter coils (33) and a socket cover (50).

The chassis (10) has a front, a rear and multiple holes (121), may be step-shaped and may have a lower level (11), an upper level (12), two sides, two transverse protrusions (13), two notches (111) and two clamps (112). The holes (121) are formed vertically through the rear of the chassis (10). The lower level (11) is formed on the chassis (10) near the front. The upper level (12) is formed on the chassis (10) near the rear and is higher than the lower level (11). The transverse protrusions (13) are formed respectively on the two side surfaces of the chassis (10). The notches (111) are formed respectively on the front and the sides of the chassis (10). The clamps (112) are formed on the lower level (11).

Figure 5:
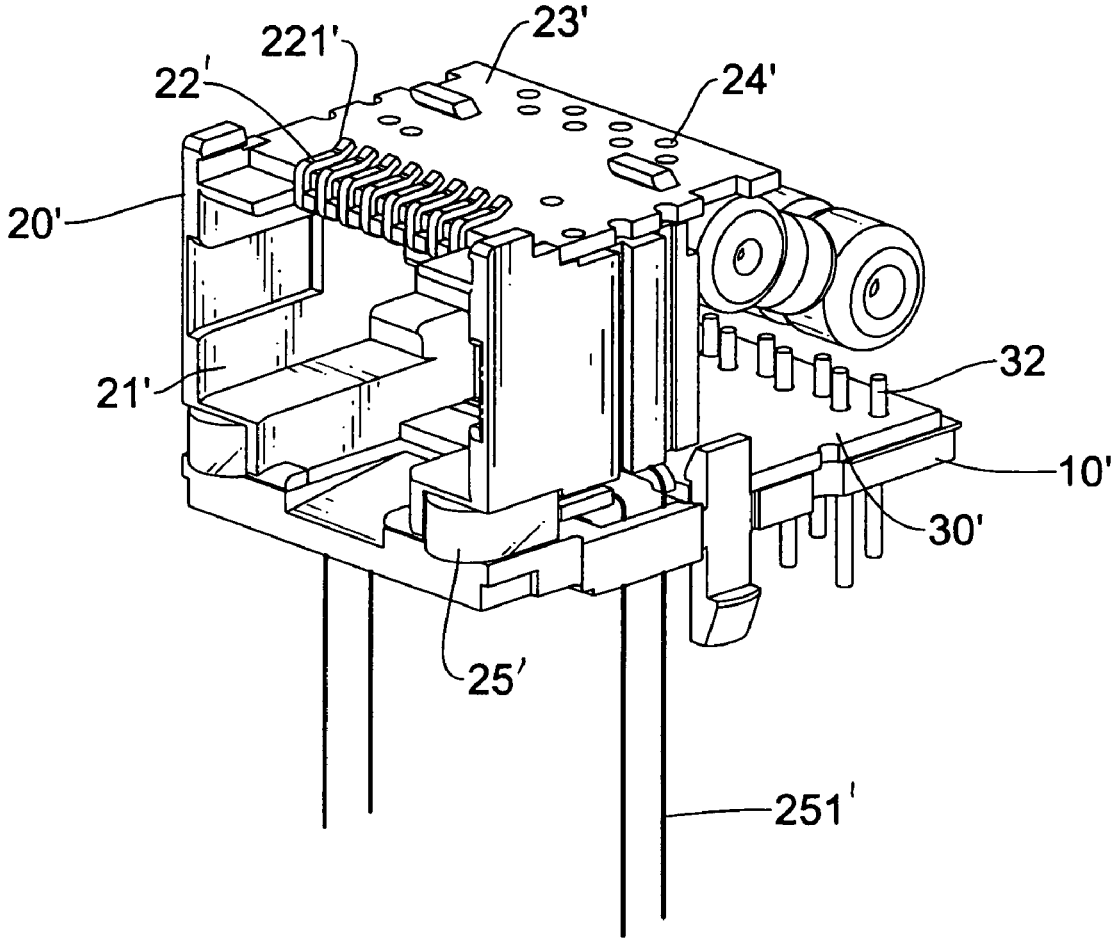
FIG. 5 is a perspective view of another embodiment of an RJ-45 socket in accordance with the present invention without a chassis cover and a socket cover.

With further reference to FIG. 5, the main circuit board (30, 30') is mounted on the chassis (10) near the rear of the chassis (10) and has a front, a rear, multiple through holes (31) and multiple electrical prongs (32). The through holes (31) are formed through the main circuit board (30, 30') near the front of the main circuit board (30). The electrical prongs (32) are attached to the rear of the main circuit board (30, 30') and correspond to and extend through the holes (121) in the chassis (10).

Figure 2:
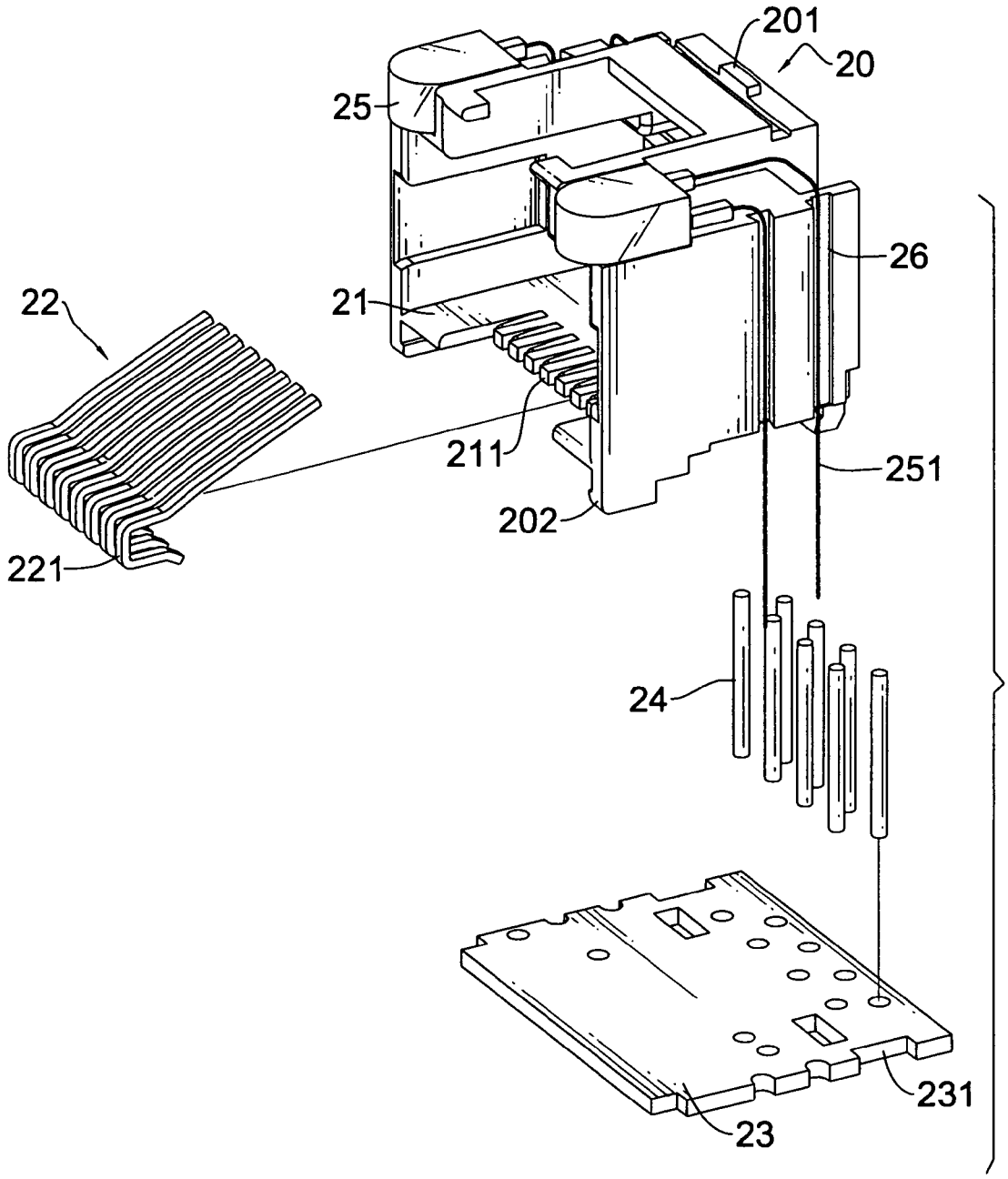
FIG. 2 is an exploded perspective view of a socket block of the RJ-45 socket in FIG. 1.

With further reference to FIGS. 2 and 5, the socket block (20, 20') is mounted on the chassis (10) near the front of the chassis (10) and has a front end, a top, a bottom, two sides, a cavity (21, 21'), a secondary circuit board (23, 23'), a contact assembly (22, 22'), multiple internal leads (24, 24'), two optional pairs of wireways (26), two light-emitting diodes (LEDs) (25, 25'), an optional protrusion (201) and two optional hooks (202). The cavity (21, 21') is formed on the front end of the socket block (20) and has multiple contact notches (211). The contact notches (211) are formed in the cavity (21, 21') and may be formed in the bottom of the socket block (20) or in the top of the socket block (20'). The secondary circuit board (23, 23') is mounted on the socket block (20, 20'), may be mounted on the bottom of the socket block (20) or may be mounted on the top of the socket block (20') and has a front end, a rear end and two optional clamp recesses (231). The clamp recesses (231) are formed in the secondary circuit board (23) and correspond to and engage the clamps (112) on the chassis (10). The contact assembly (22, 22') is mounted in the contact notches (211)

in the cavity (21, 21') and has multiple resilient contacts (221, 221'). The resilient contacts (221, 221') are mounted respectively in the contact notches (211) and electrically connect to the secondary circuit board (23, 23'). The internal leads (24, 24') are attached to the rear of the secondary circuit board (23, 23') and protrude through the through holes (31) in the main circuit board (30) to electrically connect the secondary circuit board (23, 23') to the main circuit board (30, 30'). The two pairs of wireways (26) are formed respectively in the two sides of the socket block (20). The LEDs (25, 25') are mounted on the socket block (20, 20') respectively near the sides, may be mounted on the top of the socket block (20) or may be mounted on the bottom of the socket block (20'), and each LED (25) has two wires (251, 251'). The wires (251, 251') extend through the chassis (10) and may be routed respectively through the wireways (26). The protrusion (201) is formed on the top of the socket block (20). The hooks (202) are formed on the bottom of the socket block (20) respectively near the two sides and correspond to and hook the notches (111) in the chassis (10).

Figure 3:
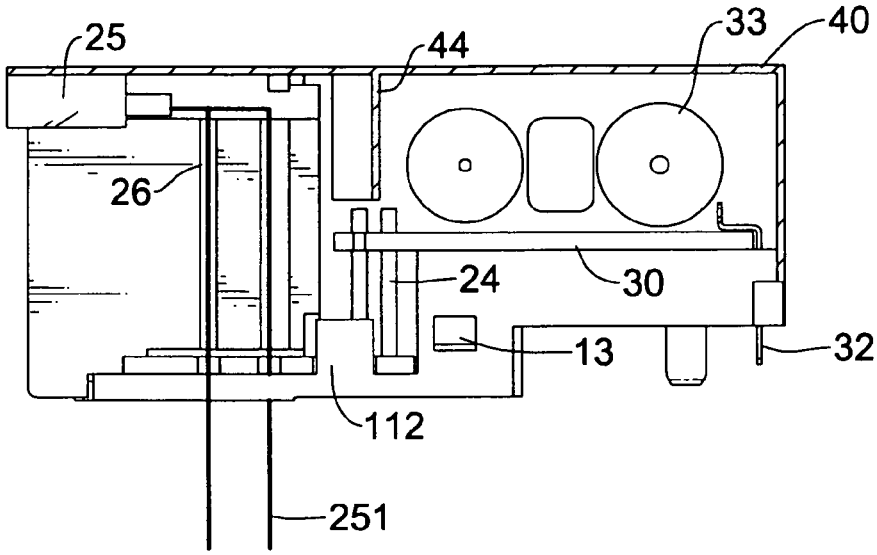
FIG. 3 is a side view in partial section of the RJ-45 socket in FIG. 1 without a socket cover.
Figure 4:
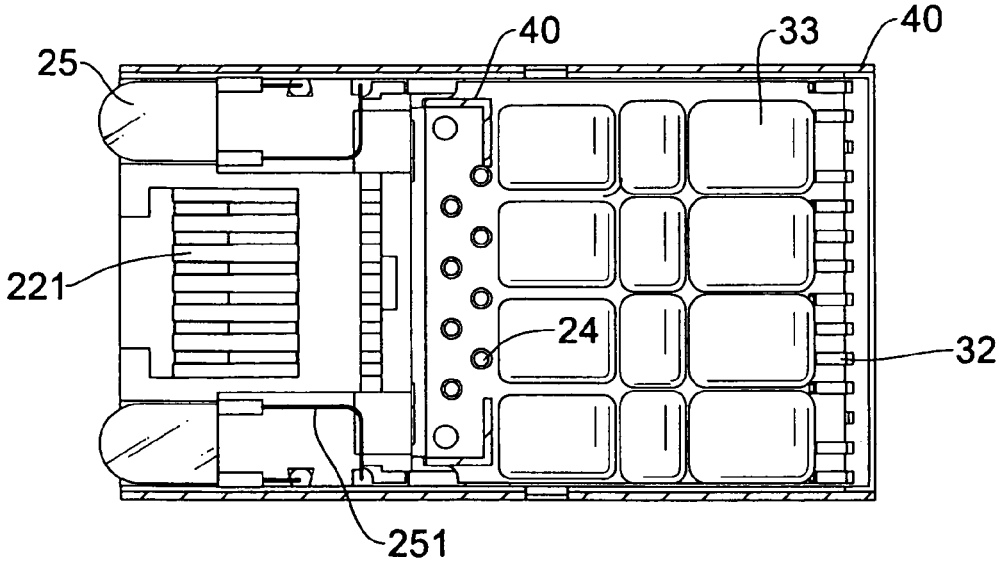
FIG. 4 is a top view in partial section of the RJ-45 socket in FIG. 1 without the socket cover.

With further reference to FIGS. 3 and 4, the chassis cover (40) is mounted securely on and covers the socket block (20), the main circuit board (30) and the chassis (10), has two L-shaped partitions (44) and may have a top, two sidewalls, a top latch hole (41), two side latch holes (42) and two vertical ribs (43). The L-shaped partition (44) is formed in the chassis cover (40) between the wires (251) of the LEDs (25) and the filter coils (33) on the main circuit board (30) to prevent interference. The top latch hole (41) is formed through the top of the chassis cover (40) and corresponds to and engages the protrusion (201) on the socket block (20). The side latch holes (42) are formed respectively through the sidewalls of the chassis cover (40) and correspond to and engage the transverse protrusions (13) on the chassis (10). The vertical ribs (43) are formed respectively on the sidewalls in the chassis cover (40) and correspond respectively to and engage one of the wireways (26) in each pair of wireways (26) in the socket block (20).

The filter coils (33) are mounted in the chassis cover (40) between the main circuit board (30, 30') and the secondary circuit board (23, 23') to filter waves and eliminate noise and may be attached to the main circuit board (30, 30') or may be attached to the secondary circuit board (23, 23').

The socket cover (50) is mounted securely on and covers the chassis cover (40), the socket block (20), the main circuit board (30) and the chassis (10).

The modular communications socket as described has to be electrically connected to a circuit board in the parent equipment and has the following advantages.

Figure 6:
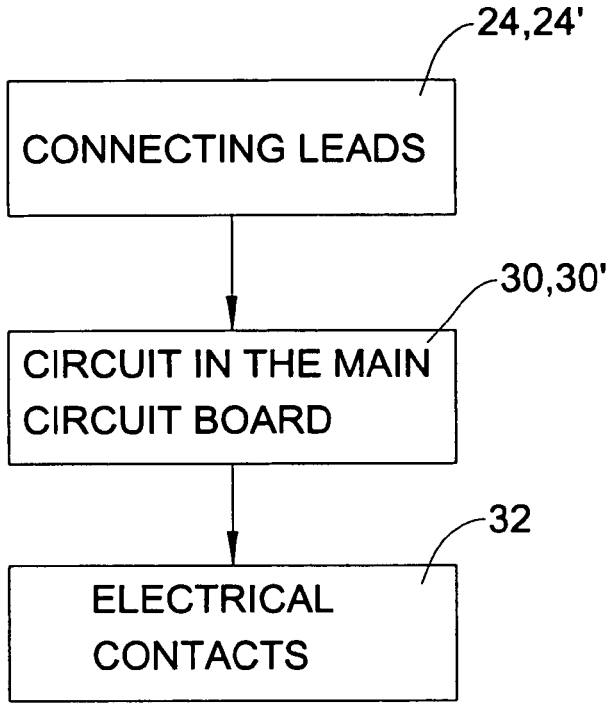
FIG. 6 is a block diagram of the internal leads electrically connecting to the electrical prongs.
Figure 7:
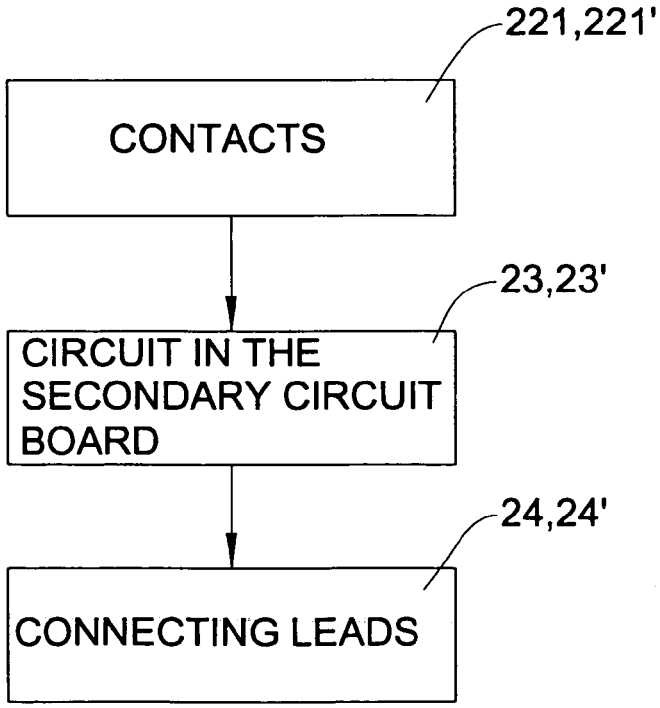
FIG. 7 is a block diagram of the resilient contacts electrically connecting to the internal leads.

1. With further reference to FIG. 6, the electrical prongs (32) on the main circuit board (30, 30') connect to a circuit board in the parent equipment. The internal leads (24, 24') are electrically connected respectively to the electrical prongs (32) to connect the secondary circuit board (23,23 ') to the parent equipment circuit board simply because the circuit in the main circuit board (30, 30') electrically connects the internal leads (24, 24') to the electrical prongs (32). With further reference to FIG. 7, the resilient contacts (221, 221') of the contact assembly (22, 22') are electrically connected respectively to the internal leads (24, 24') through circuitry on the secondary circuit board (23, 23') that are connected to the main circuit board (30, 30'). Therefore, the contact assembly (22,22') electrically connects to the parent equipment circuit board through the main and secondary circuit boards (30, 30', 23, 23').

2. Even when the modular communications socket needs to have the contact assembly (22, 22') mounted in the top of the cavity (21, 21'), the manufacturing process is easily changed by simply changing the circuit boards (30, 30', 23, 23') with the corresponding circuits.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A modular communications socket comprising a chassis having a front;

a rear; and multiple holes formed vertically through the rear of the chassis;

a main circuit board mounted on the chassis near the rear of the chassis and having a front;

a rear;

multiple through holes formed through the main circuit board near the front of the main circuit board; and multiple electrical prongs attached to the rear of the main circuit board and corresponding to and extending through the holes in the chassis;

a socket block mounted on the chassis near the front of the chassis and having a front end;

a top;

a bottom;

two sides;

a cavity formed on the front end of the socket block and having multiple contact notches formed in the cavity;

a secondary circuit board mounted on the socket block and having a front end and a rear end;

a contact assembly mounted in the contact notches in the cavity and having multiple resilient contacts mounted respectively in the contact notches and electrically connecting to the secondary circuit board;

multiple internal leads attached to the rear of the secondary circuit board and protruding through the through holes in the main circuit board to electrically connect the secondary circuit board to the main circuit board; and two light-emitting diodes (LEDs) mounted on the socket block respectively near the sides, and each LED having two wires extending through the chassis;

a chassis cover mounted securely on and covering the socket block, the main circuit board and the chassis and having two L-shaped partitions formed in the chassis cover between the wires of the LEDs and the filter coils on the main circuit board;

multiple filter coils mounted in the chassis cover between the main circuit board and the secondary circuit board; and a socket cover mounted securely on and covering the chassis cover, the socket block, the main circuit board and the chassis.

2. The modular communications socket as claimed in claim 1, wherein the contact notches in the cavity are formed in the top of the socket block;

the secondary circuit board is mounted on the top of the socket block;

the LEDs are mounted on the bottom of the socket block; and the filter coils are attached to the secondary circuit board.

3. The modular communications socket as claimed in claim 1, wherein the contact notches in the cavity are formed in the bottom of the socket block;

the secondary circuit board is mounted on the bottom of the socket block;

the LEDs are mounted on the top of the socket block; and the filter coils are attached to the main circuit board.

4. The modular communications socket as claimed in claim 3, wherein the chassis is step-shaped and has a lower level formed on the chassis near the front;

an upper level formed on the chassis near the rear and being higher than the lower level;

two sides;

two transverse protrusions formed respectively on the two side surfaces of the chassis;.

two notches formed respectively on the front and the sides of the chassis; and two clamps formed on the lower level;

the socket block further has two pairs of wireways formed respectively in the two sides of the socket block;

a protrusion formed on the top of the socket block; and two hooks formed on the bottom of the socket block respectively near the two sides and corresponding to and hooking the notches in the chassis;

the secondary circuit board further has two clamp recesses formed in the secondary circuit board and corresponding to and engaging the clamps on the chassis;

the wires of the LEDs are routed respectively through the wireways in the socket block; and the chassis cover further has a top;

two sidewalls;

a top latch hole formed through the top of the chassis cover and corresponding to and engaging the protrusion on the socket block;

two side latch holes formed respectively through the sidewalls of the chassis cover and corresponding to and engaging the transverse protrusions on the chassis; and two vertical ribs formed respectively on the sidewalls in the chassis cover and corresponding respectively to and engaging one the wireways in each pair of wireways in the socket block.

* * * * *